US006619278B1

(12) United States Patent
Lin

(10) Patent No.: US 6,619,278 B1
(45) Date of Patent: Sep. 16, 2003

(54) NON-LETHAL AMMUNITION FOR A FIREARM

(76) Inventor: Peter Lin, 345 Ivyland Rd., Warminster, PA (US) 18974

( * ) Notice: Subject to any disclaimer, the term of this patent is extended or adjusted under 35 U.S.C. 154(b) by 0 days.

(21) Appl. No.: 10/109,159

(22) Filed: Mar. 29, 2002

(51) Int. Cl.[7] ..... F41B 11/06; F42B 5/10

(52) U.S. Cl. ..... 124/57; 102/440

(58) Field of Search ..... 124/57; 102/440, 102/444; 42/1.14, 1.15

(56) References Cited

U.S. PATENT DOCUMENTS

| | | | | | |
|---|---|---|---|---|---|
| 2,375,314 | A | * | 5/1945 | Mills | 124/57 |
| 2,964,031 | A | | 12/1960 | Dotson | 124/11 |
| 3,229,420 | A | * | 1/1966 | Dias | 446/154 |
| 3,315,564 | A | | 4/1967 | Hazlett, Jr. et al. | 89/1.5 |
| 3,369,609 | A | | 2/1968 | Fogelgren | 169/31 |
| 3,889,652 | A | * | 6/1975 | Curtis | 124/41.1 |
| 4,843,750 | A | | 7/1989 | Blase | 42/95 |
| 4,998,368 | A | * | 3/1991 | Blase | 42/95 |
| 5,018,449 | A | | 5/1991 | Eidson, II | 102/498 |
| 5,078,117 | A | * | 1/1992 | Cover | 124/71 |
| 5,341,744 | A | * | 8/1994 | Shi | 102/442 |
| 5,652,405 | A | | 7/1997 | Rakov | 89/7 |
| 5,909,000 | A | | 6/1999 | Rakov | 89/7 |

FOREIGN PATENT DOCUMENTS

| | | | | |
|---|---|---|---|---|
| EP | 0499332 A1 | * | 8/1992 | F42B/6/10 |

* cited by examiner

*Primary Examiner*—Charles T. Jordan
*Assistant Examiner*—John W. Zerr
(74) *Attorney, Agent, or Firm*—LaMorte & Associates

(57) ABSTRACT

A projectile assembly that enables a compressed gas powered projectile to be fired from a traditional ammunition firearm. The projectile assembly includes a casing that is shaped like the casing of traditional ammunition. A projectile is set into the tip of the casing. Within the casing is located a compressed gas cartridge. The projectile assembly is loaded into the breech of a traditional firearm. Once the firearm is fired, the firing pin of the firearm strikes a piercing pin within the casing. The piercing pin, in turn, strikes and pierces the compressed gas cartridge. The gas pressure displaces the projectile from the tip of the casing and propels the projectile down and out the barrel of the firearm. The casing is designed so that a new compressed cartridge can be placed in the casing and the projectile replaced.

13 Claims, 3 Drawing Sheets

NON-LETHAL AMMUNITION FOR A FIREARM

BACKGROUND OF THE INVENTION

1. Field of the Invention

The present invention relates to ammunition that is fired from firearms. More particularly, the present invention relates to non-lethal ammunition that is fired from a firearm using compressed gas rather than gunpowder.

2. Prior Art Statement

In the prior art, there are many different types of guns that fire projectiles using the power of compressed gas rather than the power of an explosive, such as gunpowder. The most common examples of such prior art guns would be BB guns and paintball guns. Compressed gas is typically used in guns where it is desired to fire a projectile at subsonic speeds. Furthermore, compressed gas does not have the explosive power of gunpowder. Consequently, guns that used compressed air can be made flimsier and far less expensively than guns that fire traditional gunpowder powered bullets.

Guns that fire projectiles using compressed gas typically obtain the compressed gas from one of three sources. The first source is a manual pump. Manual pumps are used to compress air within the structure of the gun. It takes a significant amount of work to compress a small amount of air. Consequently, manual pumps are often used on BB guns, where only a small amount of compressed air is needed to fire a small, lightweight projectile.

The second type of compressed gas source is a powered compressor. Powered compressors can produce large volumes of compressed air in a relatively small time. As such, powered compressors are often used to power nail guns and other equipment that requires a large volume of compressed air to operate. However, powered compressors are very large and heavy. As such, a person cannot readily carry them from place to place. Powered compressors are therefore limited to applications where a gun is only going to be fired in a single location.

The third type of compressed gas source is a compressed gas canister. Canisters can be filled with compressed air, or other non-combustible gases, such as carbon dioxide or nitrogen. The compressed gas canisters can then be attached to the gun and used to power the gun.

Compressed gas canisters differ widely in size, shape, composition and weight. One of the smallest widely commercially available compressed gas canisters is the twenty-gram CO2 cartridge. A twenty-gram CO2 cartridge is a metal canister that is filled with twenty grams of liquid carbon dioxide. The twenty-gram CO2 cartridge has a neck that is sealed with a piercable membrane. When the piercable membrane is ruptured, the pressurized contents of the twenty-gram CO2 cartridge are released.

Since the twenty-gram CO2 cartridge is the smallest and cheapest readily available compressed gas source, it has been used to power a wide variety of guns. Many pellet guns, BB guns and paintball guns utilize twenty-gram CO2 cartridges. With such prior art guns, a twenty-gram CO2 cartridge provides enough compressed gas to fire between five and twenty five shots.

However, in the prior art, there are guns that utilize all the gas in a twenty-gram CO2 cartridge in a single shot. In one type of prior art gun, the gun merely pierces the twenty-gram CO2 cartridge and the cartridge itself becomes the projectile that is fired from the gun. Such prior art guns are exemplified by U.S. Pat. No. 5,652,405 to Rakov, entitled System For Shooting Using Compressed Air, and U.S. Pat. No. 5,909,000 to Rakov which is also entitled System For Shooting Using Compressed Air.

In other prior art guns, the twenty-gram CO2 cartridge is used to project a single secondary projectile from a gun. For instance, in U.S. Pat. No. 2,964,031 to Dotson, entitled Underwater Gun And Projectile For Spear Fishing, a twenty-gram CO2 cartridge is used to fire the harpoon of a spear gun.

Regardless of whether a gun fires multiple shots from a CO2 cartridge or a single shot, most all of the prior art guns that utilize CO2 cartridges are specialized guns that are designed to specifically receive the CO2 cartridge. Such prior art guns cannot be used to fire traditional gunpowder powered ammunition. Accordingly, if a policeman or a serviceman wants to use a compressed gas gun to fire smoke grenades or some other non-lethal projectile, they must carry a dedicated gun for that purpose. If they still desire to be armed with their traditional firearm, they must carry two guns.

A need therefore exits for a projectile system that enables a non-lethal compressed gas powered projectile to be fired from a traditional firearm, without requiring modifications to that traditional firearm. In this manner, a person can change between firing traditional gunpowder based ammunition to firing compressed air powered ammunition without having to change guns. This need is met by the present invention as described and claimed below.

SUMMARY OF THE INVENTION

The present invention is a projectile assembly that enables a compressed gas powered projectile to be fired from a traditional ammunition firearm. The projectile assembly includes a casing that is shaped like the casing of traditional ammunition. A projectile is set into the tip of the casing. Within the casing is located a compressed gas cartridge. The projectile assembly is loaded into the breech of a traditional firearm. Once the firearm is fired, the firing pin of the firearm strikes a piercing pin within the casing. The piercing pin, in turn, strikes and pierces the compressed gas cartridge. Once the compressed gas cartridge is ruptured, the pressure within the casing increases dramatically. The gas pressure displaces the projectile from the tip of the casing and propels the projectile down and out the barrel of the firearm. The remaining spent casing is ejected from the firearm in a traditional manner. The casing is designed so that a new compressed cartridge can be placed in the casing and the projectile replaced. As such, the same casing can be used numerous times and can be used to fire a variety of projectiles.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

There are many different types of firearms that fire traditional gunpowder powered ammunition. These firearms come in a wide variety of shapes, sizes, styles and designs. The size of the projectile fired by such firearms is typically referred to as the caliber of that firearm. Depending upon the model of the firearm, the caliber of the firearm is equal to the diameter of the bore in the barrel of the firearm. That diameter may be defined either in millimeters or the percentages of an inch. For instance, a firearm with a nine millimeter caliber has a barrel bore of nine millimeters. A firearm that is forty-five caliber would have a barrel bore that is 45/100ths of an inch, or 0.45 inches.

The present invention projectile assembly can be manufactured in any desired caliber. However, as will be explained, the present invention projectile assembly preferably contains a standard twenty-gram CO2 cartridge within its structure. Twenty-gram CO2 cartridges have a diameter of approximately 0.72 inches. Accordingly, to utilize conventional twenty-gram CO2 cartridges, the present invention projectile assembly is preferably made to be fired from large bore firearms that fire ammunition in excess of 72 caliber or 14.8 millimeters. Such firearms include, but are not limited to, twelve-gauge shotguns, grenade launchers, and flairguns.

Figure 1:
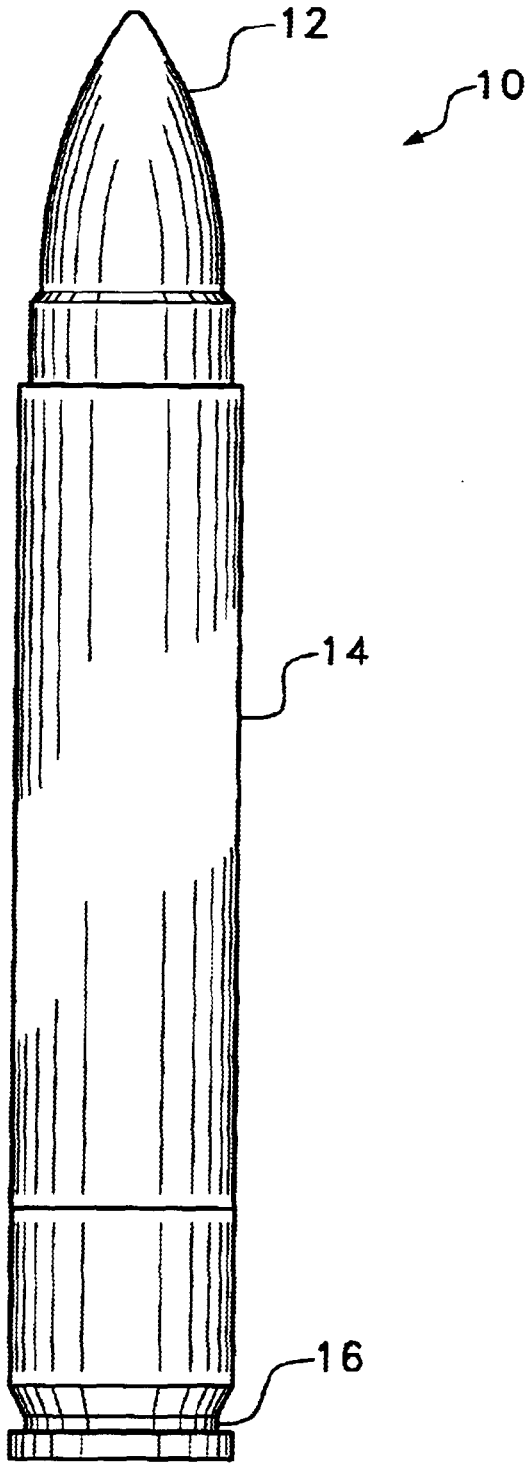
FIG. 1 is a perspective view of an exemplary embodiment of a projectile assembly in accordance with the present invention.

Referring to FIG. 1, an exemplary embodiment of the present invention projectile assembly 10 is shown. The projectile assembly 10 has a projectile 12 that is mounted to the tip of a casing 14. However, as will later be explained, the casing 14 does not contain gunpowder. Rather, the casing contains a twenty-gram CO2 cartridge. The projectile assembly 10 is placed into a firearm that normally fires gunpowder powered ammunition. The present invention projectile assembly 10 mimics the shape of the gunpowder powered ammunition and even contains a base ridge 16 that is used by a firearm to eject a spent casing after it has been fired.

When fired, the projectile 12 is propelled from the casing 14 at subsonic speeds. As such, the projectile 12 travels at non-lethal speeds from the firearm. Accordingly, rubber projectiles, for use in riot control, and other crowd control projectiles can be adapted for use as part of the present invention. Projectiles, such as smoke grenades, tear gas grenades, flares and other large projectiles that are designed to be fired at subsonic speeds can also be used.

Figure 2:
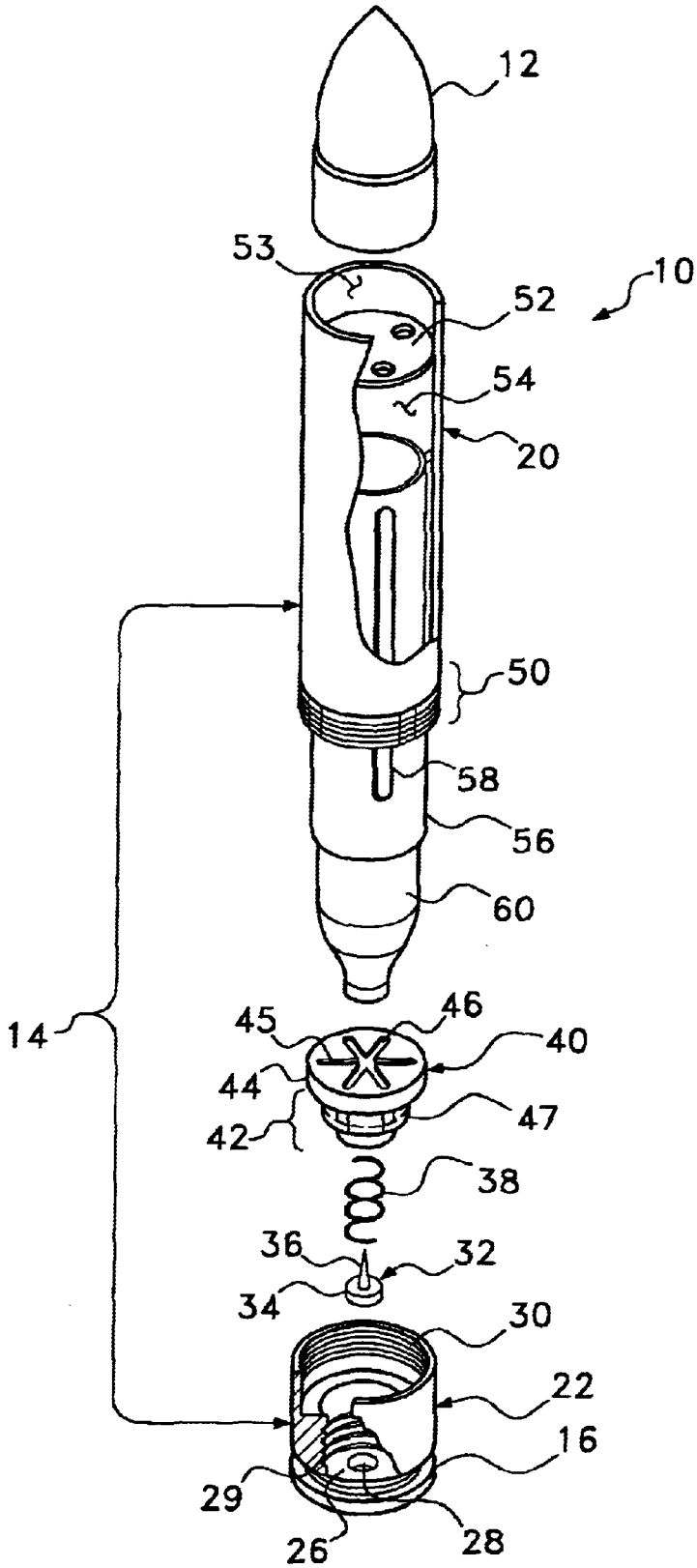
FIG. 2 is a selectively fragmented and exploded view of the projectile assembly shown in FIG. 1.

Referring now to FIG. 2, it can be seen that the projectile assembly 10 has multiple parts that are all contained within the casing 14. The casing 14 is a two part assembly, having a top section 20 and a bottom section 22. The bottom section 22 of the casing 14 contains the base ridge 16 that is used by a firearm to eject the casing 14 after it has been fired. The top section 20 of the casing 14 holds the projectile 12. The bottom section 22 of the casing 14 engages the top section 20 of the casing 14 with a threaded coupling. As such, the top section 20 of the casing 14 and the bottom section 22 of the casing 14 can be selectively connected and disconnected, thereby providing easy access to the interior of the casing 14.

The bottom section 22 of the casing 14 has a bottom base 26, wherein the walls of the casing 14 extend in a cylindrical configuration up from the bottom base 26. The exterior of the casing 14 is inset immediately before the bottom base 26, thereby forming the base ridge 16. An aperture 28 is formed in the center of the bottom base 26. As will be understood, the aperture 28 corresponds to the point where the firing pin of a firearm will strike the projectile assembly 10 when the projectile assembly is fired from a gun. The bottom section 22 of the casing 14 has internal threading in two areas. The first area of internal threading 29 extends upwardly from the bottom base 26 within the center of the bottom section 22. The second area of threading 30 is immediately adjacent the top edge of the bottom section 22 of the casing 14.

A piercing pin 32 is provided. The piecing pin 32 has an enlarged head 34 that rests in the aperture 28 in the bottom base 22 of the casing 14. The head 34 of the piercing pin 32 extends into the aperture 28 but is too large to pass through the aperture 28. A sharpened point 36 extends from the enlarged head 34 and faces vertically toward the interior of the casing 14. The head 34 of the piercing pin 32 is biased down against the aperture 28 at the bottom of the casing 14 by a return spring 38.

The return spring 38 is held in place by a threaded plug 40. The threaded plug 40 is.comprised of a hollow cylindrical section 42 and a platform 44 that is disposed on top of the cylindrical section 42. Grooves 45 are formed on the top of the platform for a purpose that will later be explained. An aperture 46 is disposed in the center of the platform that communicates with the center of the cylindrical section 42. The return spring 38 is set into the center of the cylindrical section.42. The piercing pin 32 is then placed atop the return spring 38. When pressed against the return spring 38, the sharpened point 36 of the piercing pin 32 extends through the aperture 46 in the platform 44. However, without a bias sufficient to deform the return spring 38, the sharpened point 36 of the piercing pin 32 does not extend through the aperture 46 in the platform 44.

The exterior of the cylindrical section 42 of the threaded plug 40 contains threads 47. These threads 47 engage the first area of internal threading 29 within the bottom section 22 of the casing 14. When engaged with the bottom section 22 of the casing 14, the return spring 38 becomes partially compressed and biases the head 34 of the piercing pin 32 against the aperture 28 in the base of the bottom section 22 of the casing 14.

The top section 20 of the casing 14 is tubular in shape. A threaded recessed region 50 is located near the bottom edge of the top section 20. The threaded recessed region 50 engages the second area of internal threading 30 of the bottom section 22 of the casing 14. When the top section 20 of the casing 14 is threaded into the bottom section 22 of the casing 14, the diameter of the overall casing 14 remains constant across the transition from the top section 20 of the casing 14 to the bottom section of the casing 14.

A baffle wall 52 is disposed within the top section 20 of the casing 14, thereby dividing the top section 20 of the casing 14 into two internal areas 53, 54. The baffle wall 52 is perforated. The area 53 above the baffle wall 52 receives the base of the projectile 12. The area 54 below the baffle wall 52 receives a compressed gas cartridge 60. The preferred compressed gas cartridge 60 is a twenty-gram CO2 cartridge that has an external diameter of approximately 0.72 inches. Accordingly, to receive a twenty-gram CO2 cartridge, the interior of the top section 20 of the casing 14 must be at least 0.72 inches wide.

If the projectile assembly 10 is being fired from a twelve-gauge shotgun or another firearm that has a bore caliber only slightly wider than that of the compressed gas cartridge 60, then the compressed gas cartridge 60 can be directly placed into the top section 20 of the casing 14. The top section 20 of the casing will then support the compressed gas cartridge 60 in a vertical orientation. However, if the present invention projectile assembly 10 is being manufactured for a firearm having a bore caliber that is significantly larger than the diameter of the compressed gas cartridge 60, then an optional spacing collar 56 can be placed around the compressed gas cartridge 60. The spacing collar 56 is a tubular structure that has an interior diameter that matches the exterior diameter of the compressed gas cartridge 60. On the outside of the spacing collar 56 are ribs 58. The ribs 58 extend outwardly to a diameter that matches the diameter of the interior of the top section 20 of the casing 14. The ribs 58 also enable gas to pass between the interior of the top section 20 of the casing 14 and the spacing collar 56, for a reason that is later explained.

When a compressed gas cartridge 60 is placed into the top section 20 of the casing 14 and the top section 20 of the casing 14 is attached to the bottom section 22 of the casing 14, the piercable membrane on the compressed gas cartridge 60 rests on the top of the threaded plug 40 directly over the; aperture 46 in the platform 44.

Figure 3C:
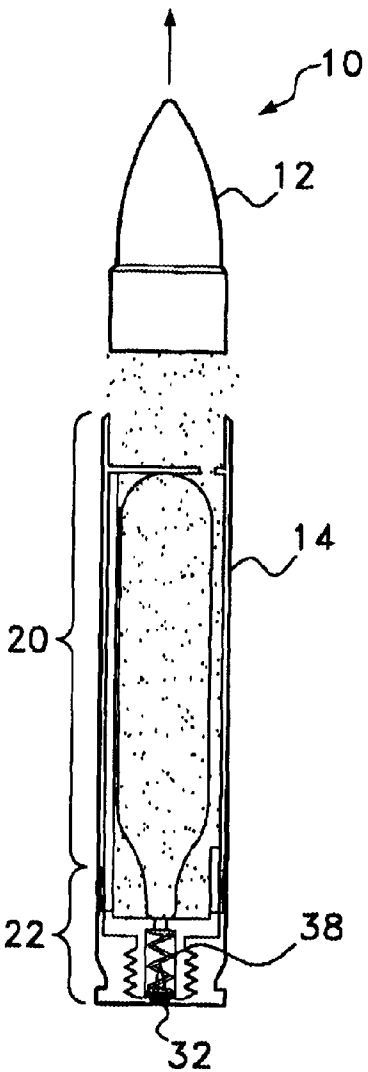
FIG. 3C is a cross-sectional view of the projectile assembly shown after it has been fired.
Figure 3B:
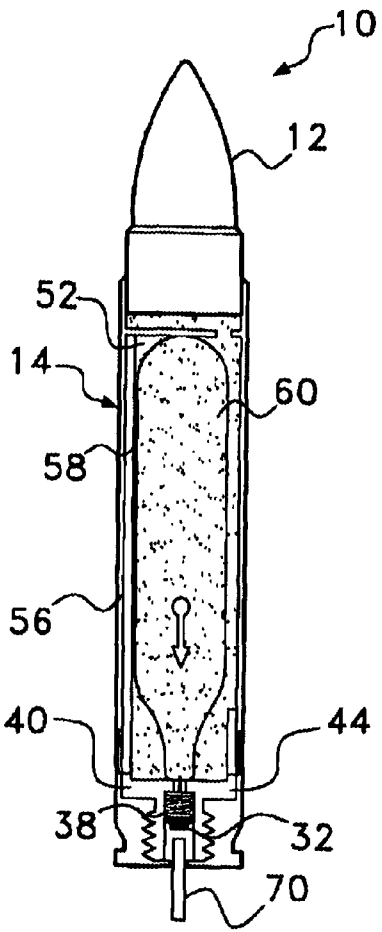
FIG. 3B is a cross-sectional view of the projectile assembly shown while being fired.
Figure 3A:
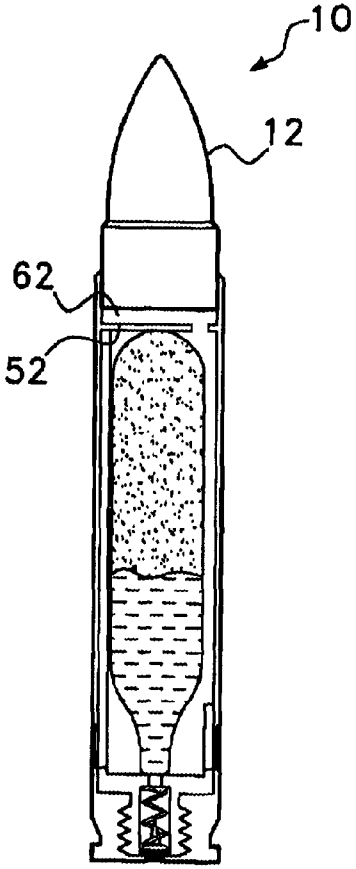
FIG. 3A is a cross-sectional view of the projectile assembly shown prior to being fired.

Referring to FIG. 3A, it can be seen that a gap 62 exists between the baffle wall 52 and the bottom of the projectile 12, when the projectile 12 is seated in the casing 14. The overall projectile assembly 10 has the same shape and appearance, as does traditional gunpowder powered ammunition. The projectile assembly 10 can therefore be loaded into any conventional firearm having the appropriate barrel bore size and breech.

Referring to FIG. 3B, it can be seen that when the firing pin 70 of a firearm strikes the piercing pin 32, the piercing pin 32 deforms the return spring 38 and the piercing pin 32 punctures the compressed gas cartridge 60. Once punctured, the compressed gas within the compressed gas cartridge 60 flows out through the puncture hole. The grooves 45 (FIG. 2) in the platform 44 of the threaded plug 40 enable the gas to flow unobstructed into the interior of the casing 14. The gas flows around the compressed gas cartridge, utilizing the spaces between the ribs 58 of the spacing collar 56. Finally, the compressed gas flows through the baffle wall 52 and fills the gap below the projectile 12. The gas pressure increases under the projectile 12 until the projectile 12 is forced out of the casing 14. Referring to FIG. 3C, the projectile 12 is then displaced from the casing 14 and fired down the barrel of the firearm. Depending upon the mass of the projectile and the bore of the firearm, muzzle velocities of between 100 feet per second and 800 feet per second can be achieved utilizing the compressed gas contained in a twenty gram CO2 cartridge.

From FIG. 3C, it can be seen that once the projectile 12 is fired, the return spring 38 returns the piercing pin 32 to its original orientation. Since the spent casing 14 has the same shape as a traditional ammunition casing, the spent casing 14 can be ejected from the firearm utilizing the ejection mechanisms of that firearm. However, once the spent casing is ejected from the firearm, it need not be discarded. Rather, a new projectile can be pressed into the casing 14. The top section 20 of the casing 14 can then be detached from the bottom section 22 of the casing 14 and the new unused compressed gas cartridge can be placed into the casing 14. The projectile assembly 10 is then ready to be reused. Accordingly, each time the present invention projectile assembly 10 is fired, only the projectile 12 and the compressed gas cartridge 60 need to be replaced before the projectile assembly 10 is ready to be fired again.

It will be understood that the embodiment of the present invention described and illustrated is merely exemplary and a person skilled in the art can make many variations to the shown embodiments. For example, the outer diameter of the projectile assembly can be made to be any size greater than 0.72 inches. Furthermore, the size, shape and composition of the projectile can be changed to meet any requirements. The projectile can be metal, rubber, plastic, a smoke grenade, tear gas grenade, flare or the like. Lastly, the present invention assembly is shown utilizing a twenty-gram CO2 cartridge. Larger cartridges do exist. Other size cartridges can be adapted for use-as part of the present invention. All such alternate embodiments and modifications are intended to be included within the scope of the present invention as defined below in the claims.

What is claimed is:

1. A projectile assembly for a firearm, comprising:

a casing defining an internal chamber, said casing having a top end, a bottom end, a first section and a second section, wherein said first section and said second section can be selectively detached to access said internal chamber;

a piercing pin supported by said bottom end of said casing, wherein said piercing pin has a sharpened point that enters said internal chamber when said piercing pin is struck;

a projectile coupled to said casing at said top end, said projectile separating from said casing when said internal chamber is pressurized above a predetermined pressure.

2. The assembly according to claim 1, further including a compressed gas cartridge disposed in said internal chamber, wherein said piercing pin pierces said compressed gas cartridge when struck, thereby raising gas pressure in said internal chamber to a pressure over said predetermined pressure.

3. The assembly according to claim 2, wherein said compressed gas cartridge is a cartridge of carbon dioxide gas.

4. The assembly according to claim 1, further including a tubular spacer disposed within said internal chamber, said tubular spacer having a cylindrical wall and ribs that radially extend from said cylindrical wall.

5. The assembly according to claim 1, further including a perforated baffle wall disposed within said internal chamber.

6. The assembly according to claim 5, wherein a gap is disposed between said baffle wall and said projectile.

7. A projectile assembly for a firearm having a firing pin, said projectile assembly comprising;

a casing defining an internal chamber;

a cartridge of compressed gas disposed within said internal chamber of said casing;

a piercing pin supported by said casing, said piercing pin extending into said internal chamber and piercing said cartridge of compressed gas when struck by the firing pin of the firearm;

a projectile coupled to said casing, said projectile separating from said casing when said cartridge of compressed gas is pierced by said piercing pin in said internal chamber; and a perforated baffle wall disposed within said internal chamber, wherein said cartridge of compressed gas is disposed on one side of said baffle wall and said projectile is disposed on an opposite side of said baffle wall.

8. The assembly according to claim 7, wherein said compressed gas cartridge is a cartridge of carbon dioxide gas.

9. The assembly according to claim 7, wherein said casing has a first section and a second section that can be detached to selectively replace said cartridge of compressed gas from within said internal chamber.

10. The assembly according to claim 7, further including a tubular spacer surrounding said cartridge of compressed gas within said internal chamber, said tubular spacer having a cylindrical wall and ribs that radially extend from said cylindrical wall.

11. The assembly according to claim 7, wherein a gap is disposed between said baffle wall and said projectile.

12. A method comprising the steps of:

providing a casing that defines an internal chamber, said casing having a piercing pin that can extend into said internal chamber when struck;

joining a projectile to said casing that remains joined to said casing until pressure within said internal chamber exceeds a predetermined threshold pressure;

placing a container of compressed gas in said internal chamber;

placing said casing in a firearm having a firing pin;

piercing said container of compressed gas with said piercing pin by striking said piercing pin with said firing pin, wherein said container of compressed gas pressurizes said internal chamber to a pressure that exceeds said threshold pressure, thereby firing said projectile.

13. The method according to claim 12, wherein said step of placing a container of compressed gas in said internal chamber, includes the substeps of:

separating said casing into two separate sections, thereby exposing said internal chamber;

inserting said container of compressed gas into said internal chamber, and reassembling said two separate sections of said casing.

* * * * *